US007152517B1

(12) United States Patent
Ivey

(10) Patent No.: US 7,152,517 B1
(45) Date of Patent: Dec. 26, 2006

(54) DEFENSIVE SHIELD

(76) Inventor: DC Ivey, 3320 Dundle Rd., Fayetteville, NC (US) 28306

( * ) Notice: Subject to any disclaimer, the term of this patent is extended or adjusted under 35 U.S.C. 154(b) by 133 days.

(21) Appl. No.: 10/278,665

(22) Filed: Oct. 23, 2002

Related U.S. Application Data

(63) Continuation-in-part of application No. 09/981,602, filed on Oct. 18, 2001, now abandoned.

(51) Int. Cl.
*F41H 5/00* (2006.01)

(52) U.S. Cl. ..... 89/36.01; 89/36.12; 114/9; 114/240 R; 114/240 B

(58) Field of Classification Search ..... 89/36.01, 89/36.12; 428/911; 114/240 R, 361, 9, 284, 114/240 B
See application file for complete search history.

(56) References Cited

U.S. PATENT DOCUMENTS 615,039 A * 11/1898 Norton ..... 114/13
1,179,113 A * 4/1916 Kurze ..... 114/13
1,223,536 A * 4/1917 Travelstead ..... 114/240 B
1,262,346 A * 4/1918 Hough ..... 114/13
1,263,003 A * 4/1918 Thomas ..... 114/240 B
1,280,771 A * 10/1918 Lazowski ..... 114/240 R
1,293,289 A * 2/1919 Zabawa ..... 114/240 B
1,324,904 A * 12/1919 Knapp ..... 89/36.12
2,283,484 A * 5/1942 Bak ..... 114/13
2,871,763 A * 2/1959 Blomquist ..... 89/36.08
3,137,205 A * 6/1964 Berge et al. ..... 89/36.02
3,288,421 A * 11/1966 Peterson ..... 248/396
3,590,685 A * 7/1971 Lane ..... 89/36.09
3,983,832 A * 10/1976 Kinder ..... 440/12.63
4,398,446 A * 8/1983 Pagano et al. ..... 89/36.08
4,524,674 A * 6/1985 Gilvydis ..... 89/36.08
4,690,094 A * 9/1987 Taylor ..... 114/284
4,796,366 A * 1/1989 Scully ..... 37/304
4,801,239 A * 1/1989 Austad ..... 414/680
5,421,284 A * 6/1995 Wardavoir ..... 114/361
5,573,218 A * 11/1996 Vaassen et al. ..... 248/371
5,576,508 A * 11/1996 Korpi ..... 89/36.01

* cited by examiner

*Primary Examiner*—M. Clement
(74) *Attorney, Agent, or Firm*—Coats & Bennett, P.L.L.C.

(57) ABSTRACT

A defensive shield for a ship has a support arm, pivotally mounted to a ship, and a shield pivotally mounted to one end of the support arm. The support arm is movable between a retracted position and a plurality of deployed defensive positions. In the deployed positions, the shield is outwardly spaced from the ship and angled to defend against attacks, such as aerial attacks and underwater attacks.

18 Claims, 7 Drawing Sheets

SIDE VIEW

TOP VIEW

DEFENSIVE SHIELD

This application is a continuation-in-part of now abandoned U.S. application Ser. No. 09/981,602 filed Oct. 18, 2001.

BACKGROUND OF THE INVENTION

The present invention relates generally to defensive systems and, in particular, to defensive shields used by ships to defend against attacks.

Military vessels are usually equipped with defensive armor plating to protect against attack. The armor plating frequently comprises a thick, heavy plate that may be affixed to, or is integral with, a ship's hull. The added mass of the armor plating, however, may reduce the ship's speed and maneuverability. Additionally, fixed or integrated armor plating does not allow for a spatial separation between the armor plating and the ship's hull, thereby prohibiting the selective re-positioning of the armor independently from the position of the ship.

Thus, while the armor may protect the ship, protection is limited to only those places wherein the armor affixes to the hull. This does not protect the ship in all places and leaves the ship venerable to certain types of attack, such as aerial and underwater attacks. Therefore, there remains a need for a defensive shield system that permits selective re-positioning of a shield into various defensive postures that protect against attacks from a plurality of different angles.

SUMMARY

A defensive shield for a ship has a support arm pivotally mounted to a ship, and a shield pivotally mounted to an end of the support arm. In one embodiment, the shield is outwardly spaced from the ship, and may be selectively positioned between first and second deployed positions. In the first deployed position, the shield is raised above the waterline and angled upwards to defend against aerial attacks, while in the second deployed position, the shield is at least partially submerged below the waterline to defend against underwater attacks. The shield may also assume a plurality of intermediate positions, and may be retracted against the side of the ship when not deployed.

DETAILED DESCRIPTION OF THE INVENTION

Figure 1:
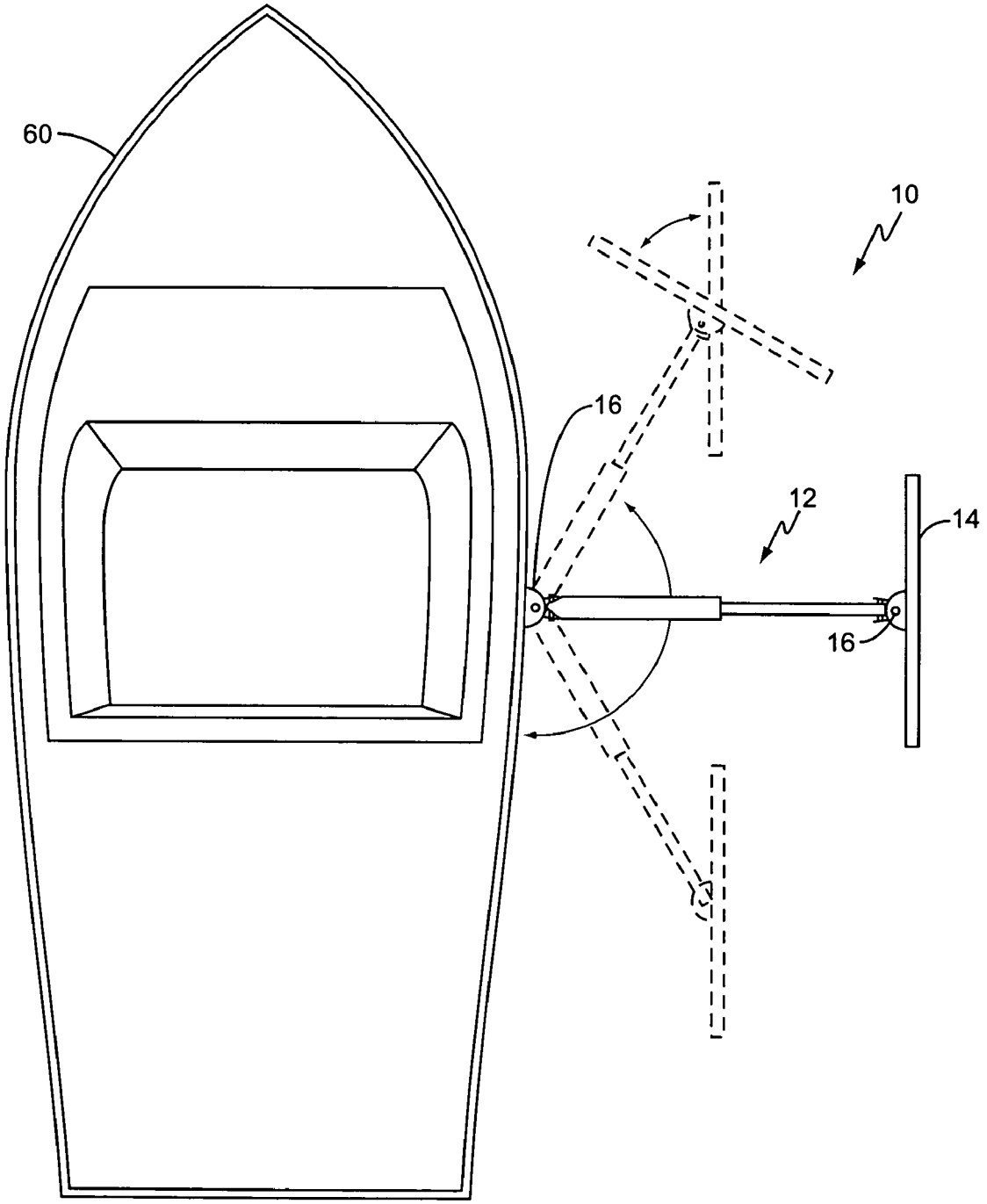
FIG. 1 illustrates one embodiment of the present invention installed on a ship.

Referring now to FIG. 1, one embodiment of the present invention is shown therein and indicated generally by the number 10. Defensive shield 10 comprises a support arm 12, and a shield 14. A hinge 16 pivotally mounts the support arm 12 to a ship 60, while another hinge 16 pivotally mounts the shield 14 to an end of the support arm 12. As will be described later in more detail, ship 60 may include a control system to independently position support arm 12 and shield 14, thereby allowing the defensive shield 10 to assume a plurality of defensive postures to defend against aerial and underwater attacks, for example.

Figure 2:
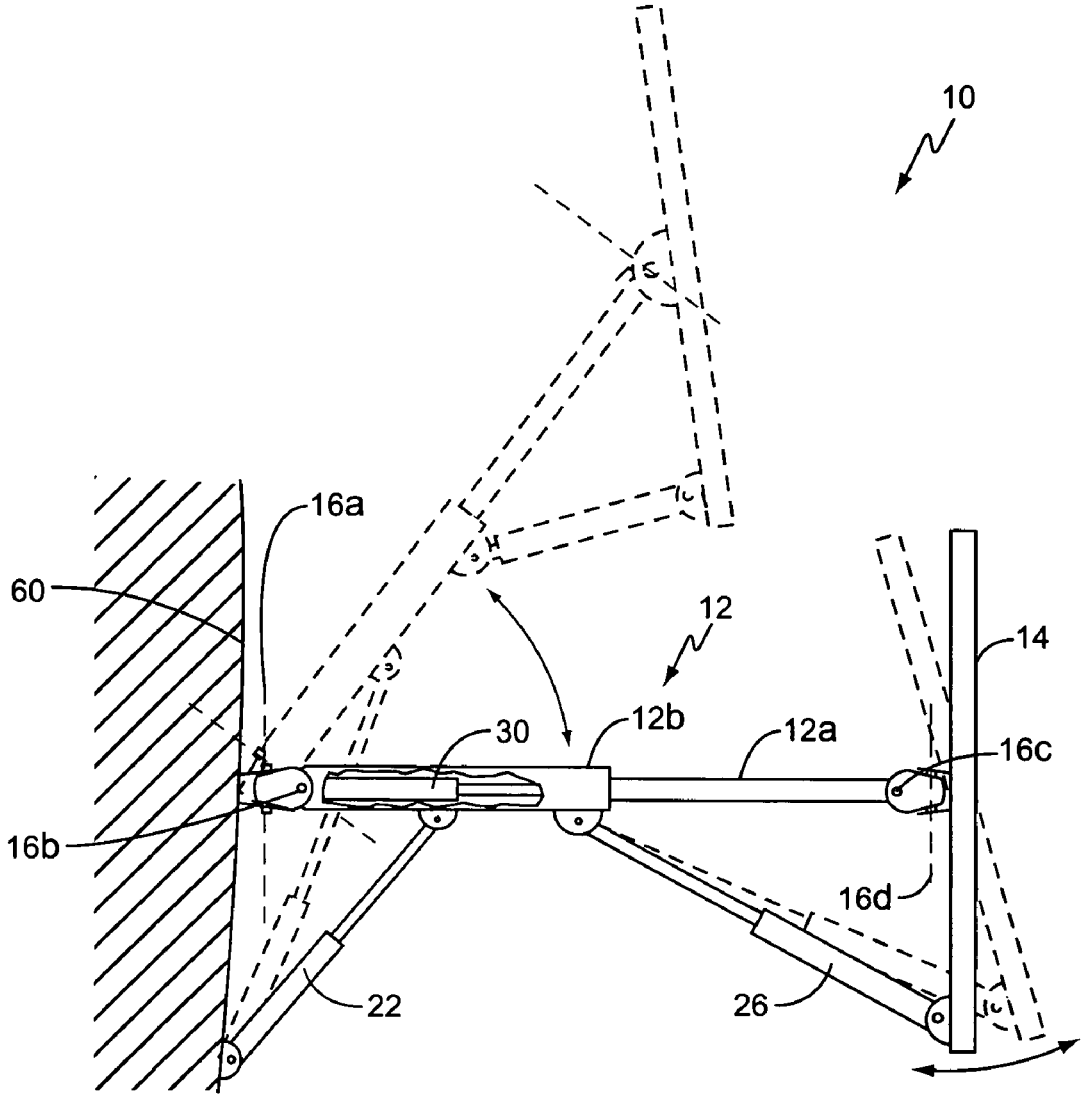
FIG. 2 is a side view of one embodiment of the present invention.

The support arm 12 may be an articulating arm. For example, FIG. 2 illustrates the support arm 12 as a telescoping arm comprising an extendable shaft 12*a*, and a sleeve 12*b* that receives an end of extendable shaft 12*a*. An extension controller 30 controls the movement of the shaft 12*a*, such that shaft 12*a* extends out of, and retracts into, sleeve 12*b*. Those skilled in the art will readily appreciate the many devices that will suffice in controlling the extension and retraction of shaft 12*a*; however, in the embodiment of FIG. 2, the extension controller 30 comprises a fluid cylinder that actuates automatically in response to an impending attack. Thus, upon attack, the extension controller 30 extends the shaft 12*a* outwardly from the sleeve 12*b* to deploy the shield 14 outwardly from the ship. When the attack is over, extension controller 30 retracts shaft 12*a* into sleeve 12*b*.

Extending the support arm 12 outwardly from the ship 60 provides a spatial buffer between the ship 60 and the shield 14. This helps to protect the ship 60 from secondary fragmentation, for example, as impacting missiles and rockets may explode upon impact with the shield 14. Note, however, that fully extending the shaft 12*a* out of sleeve 12*b* is not necessary in order for the defensive shield 10 to protect the ship 60 against an attack. In fact, the shaft 12*a* may not be extended at all. It is possible to protect the ship 60 simply by pivoting the sleeve 12*b* of support arm 12 away from the side of the ship 60 without extending the shaft 12*a* out of the sleeve 12*b*. Further, as shown in later figures, the defensive shield 10 also may also protect the ship 60 when stowed in the retracted position. In the retracted position, shield 14 provides ship 60 with armor in addition to the armor that may already be incorporated into the ship 60.

The shield 14 may be a plate of metal armor or carbon composite material able to withstand the explosive impact of rockets, missiles, or other high-velocity projectiles fired at the ship 60. For example, shield 14 may be constructed of multiple layers, wherein an outer layer includes a KEVLAR material, and inner layers include a shock absorbing or energy dissipating material. Alternatively, shield 14 may comprise a thick, single layer of a composite metal alloy. However, while the material used in the construction of the shield 14 is not important, it is preferably constructed from a material having high energy absorbing and/or energy dissipating characteristics.

As previously stated, both support arm 12 and shield 14 pivotally mount to their respective mounting surfaces. That is, one of the hinges 16 pivotally mounts the support arm 12 to the ship 60, while the other hinge 16 pivotally mounts shield 14 to the end of the support arm 12. It should be noted that while the Figures show similar hinges 16 used to mount both support arm 12 to the ship 60, and shield 14 to support arm 12, this is not a requirement and different hinges might in fact be used.

The hinges 16 may be any hinges known in the art, such as a universal joint for example. However, to permit the selective positioning of the defensive shield 10, hinges 16 should provide at least two degrees of freedom to both the support arm 12 and the shield 14. This allows the support arm 12 to move both vertically and horizontally with respect to the side of the ship, and further, permits the shield 14 to pivot or tilt vertically and horizontally with respect to the support arm 12. Those skilled in the art will readily appreciate, however, that hinges 16 may provide more than two degrees of freedom to the support arm 12 and/or shield 14, thereby allowing support arm 12 and/or shield 14 to be independently positioned in a plurality of defensive postures.

FIG. 2 illustrates in more detail the vertical movement of support arm 12, and the vertical tilt of shield 14. An elevational controller 22 controls the vertical movement of support arm 12. The elevational controller 22 may comprise a fluid cylinder having one end coupled to the ship 60, and the other end coupled to the sleeve 12*b* of support arm 12. Likewise, a vertical tilt controller 26 controls the vertical tilt of shield 14, and includes a fluid cylinder coupled to the sleeve 12*b* of support arm 12 and shield 14.

When actuated, the elevational controller 22 elevates or lowers support arm 12 to a selected position, such that support arm 12 pivots about horizontal axis 16*b*. This moves support arm 12 up and down through a horizontal plane defined by the hinge 16 on the side of the ship 60 with respect to the waterline. The vertical tilt controller 26 pivots the shield 14 about axis 16*c* independently from the movement of the support arm 12, such that shield 14 may assume a plurality of tilt angles with respect to the support arm 12. Thus, the elevational controller 22 and the vertical tilt controller 26 facilitate the selective vertical positioning of the defensive shield 10 at any angle with respect to the side of the ship.

For example, raising the support arm 12 upwardly and vertically tilting shield 14 deploys the defensive shield 10 to defend the ship 60 against aerial attacks. Alternatively, lowering support arm 12, such that shield 14 is at least partially submerged below the waterline, and vertically tilting shield 14 to a desired angle, deploys the defensive shield 10 to defend against underwater attacks. Those skilled in the art will readily appreciate from the Figures that the defensive shield 10 is not limited to merely defending against aerial and underwater attacks. Rather, support arm 12 and shield 14 may be moved and/or tilted to any selected vertical position, thereby deploying defensive shield 10 against an attack from other angles as well.

Figure 3:
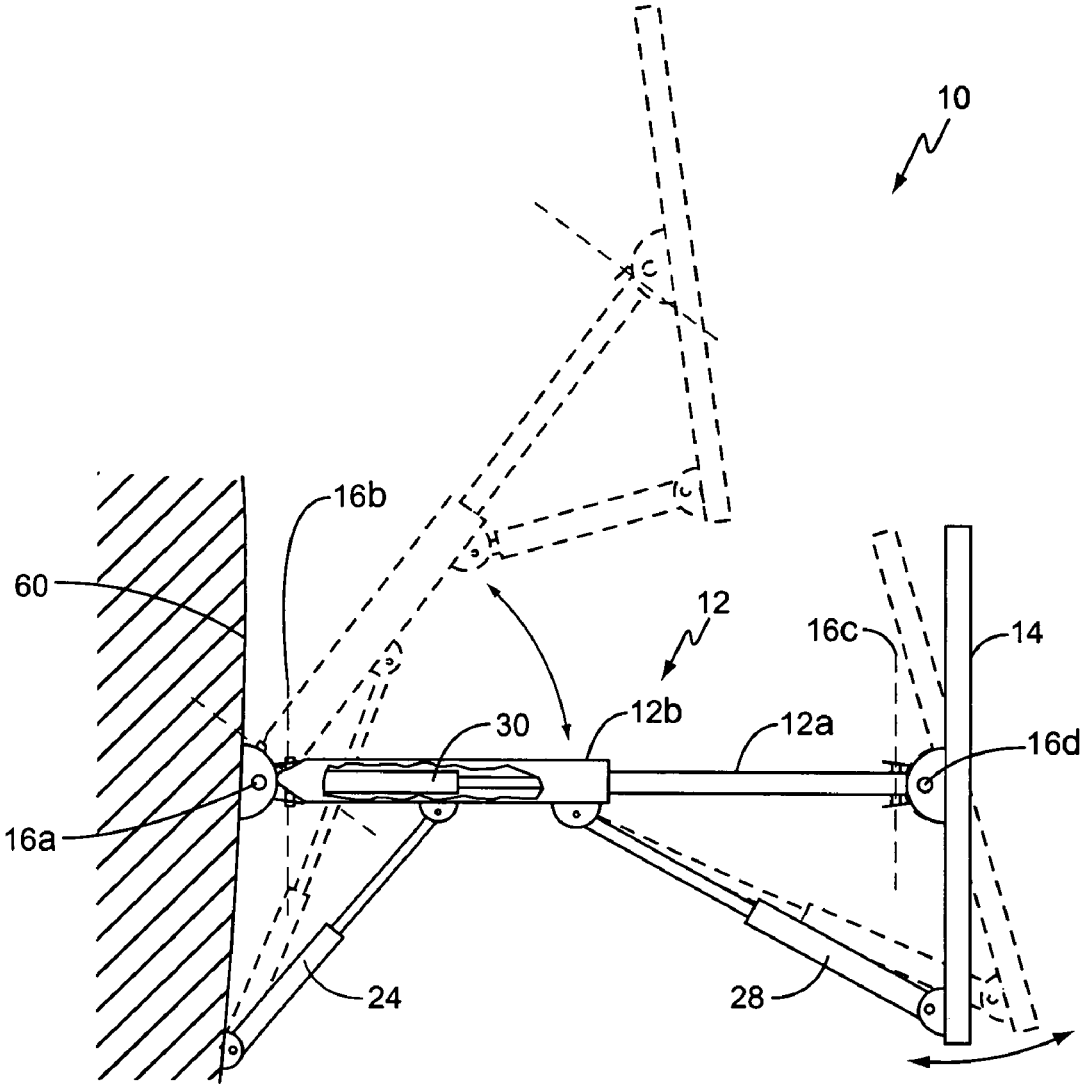
FIG. 3 is a top plan view of one embodiment of the present invention.

In addition to the vertical movement and tilt, support arm 12 and shield 14 may also be positioned horizontally. FIG. 3 shows a lateral controller 24 that moves the support arm 12 horizontally, and a horizontal tilt controller 28 that tilts the shield 14. The lateral controller 24 and horizontal tilt controller 28 may also comprise fluid cylinders. Lateral controller 24 pivots support arm 12 about vertical axis 16*a*, and facilitates the side-to-side movement of support arm 12. Horizontal tilt controller 28 pivots the shield 14 about vertical axis 16*d*, and tilts the shield 14 horizontally with respect to the support arm 12. Like the elevational controller 22 and vertical tilt controller 26, the lateral controller 24 and horizontal tilt controller 28 selectively position defense shield 10 to protect the ship 60 against attack.

Figure 4:
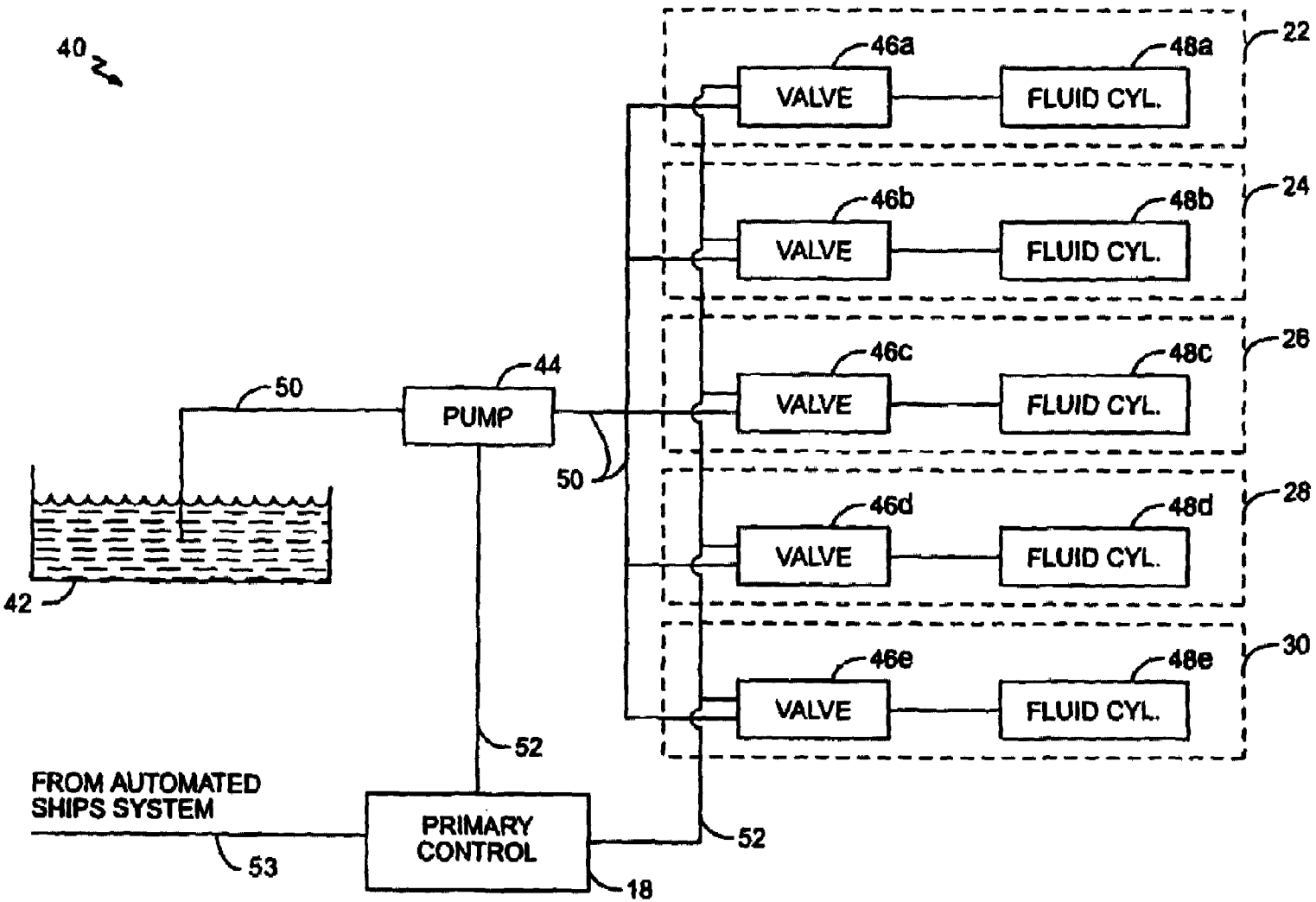
FIG. 4 illustrates an exemplary hydraulic system used in one embodiment of the present invention.

The ship 60 may include an automated control system coupled to the ship's defense systems (e.g., radar, etc.) that automatically deploy the defensive shield 10 in an appropriate position to defend against imminent attack. FIG. 4 illustrates an example of one such system, however, those skilled in the art will readily appreciate that there are many ways in which to control the deployment of defensive shield 10, and the present invention is not limited to the control system shown therein.

Hydraulic system 40 comprises a reservoir 42 containing hydraulic fluid, a primary controller 18 coupled to the ship's automated defense systems (not shown) via line 53, and a pump 44 driven by the primary controller 18. Each controller 22–30, also referred to collectively as secondary controllers 22–30, comprises a valve 46 and a fluid cylinder 48. A control line 52 electrically couples the pump 44 and valves 46 to the primary controller 18, while hydraulic line 50 couples the pump 44 to the valves 46 and fluid cylinders 48.

When the ship's automated defensive systems determine that an attack is imminent, for example, it may signal the primary controller 18 via line 53 to deploy the defensive shield 10. In response, the primary controller 18 signals both the pump 44 and the valves 46 via line 52 accordingly. The pump 44 then moves hydraulic fluid from the reservoir 42 to the selected valves 46 signaled by the primary controller 18, which then permits the passage of the hydraulic fluid through hydraulic line 50 and into its corresponding fluid cylinder 48. As the hydraulic fluid is pumped into the fluid cylinders 48 the hydraulic fluid pressure increases to extend the shaft 12*a* outwardly from sleeve 12*b*, raise or lower the support arm 12, and vertically and/or horizontally tilt the shield 14 to the selected angle. When the attack is over, the automated defense systems may signal the primary controller 18 to retract the defensive shield 10 from it's deployed position. Thus, the primary controller 18 signals valves 46 and pump 44 to release the hydraulic fluid from the fluid cylinders 48, thereby decreasing the hydraulic fluid pressure and returning the defensive shield 10 to its retracted position.

Figure 5:
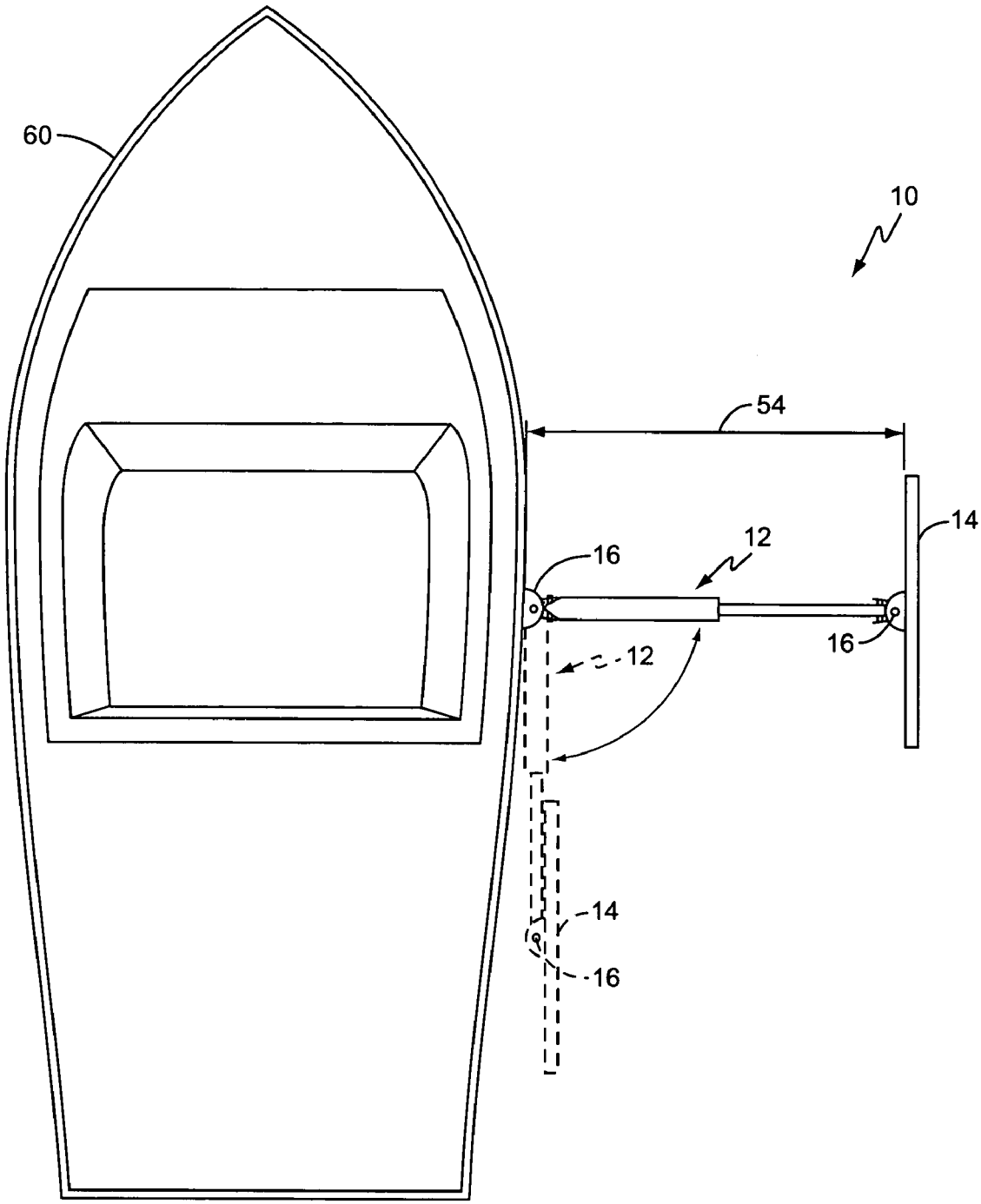
FIG. 5 illustrates an exemplary retraction position for one embodiment of the present invention.

FIG. 5 illustrates the defensive shield 10 as it moves between the retracted position and an exemplary deployed position. In this embodiment, the defensive shield 10 assumes the retracted position by retracting shaft 12*a* into sleeve 12*b* of support arm 12, and folding the shield 14 over the support arm 12. Further, in this embodiment, the support arm 12 is adjacent the hull of the ship 60 when it assumes the retracted position. However, it should be understood that defensive shield 10 may assume alternate retracted positions. For example, support arm 12 may be folded, or substantially retracted within the hull of ship 60, such that only the shield 14 remains visible outside the hull.

When the defensive shield 10 assumes one of the plurality of possible deployed positions, the shield 14 is outwardly spaced from the ship 60, such that it creates a spatial buffer 54 between the ship 60 and the shield 14. This spatial buffer 54 may protect the ship 60, and the personnel, from the blast, the secondary fragmentation, and the ensuing fireball upon impact of an explosive missile with the shield 14. Therefore, the benefits realized by using defensive shield 10 extend beyond the energy absorbing or dissipating characteristics of the shield 14. For example, in one exemplary deployed position, the shield 14 may be selectively angled to deflect an incoming missile downward and away from the side of the ship 60. In another deployed position, the defense shield 10 offers a measure of protection against collisions with other ships. Those skilled in the art will understand that the pivoting capability of the shield 14, in conjunction with the extended support arm 12, permit for a virtually limitless number of deployment positions of the defensive shield 10, and is useful to defend against an attack from any angle.

Figure 6:
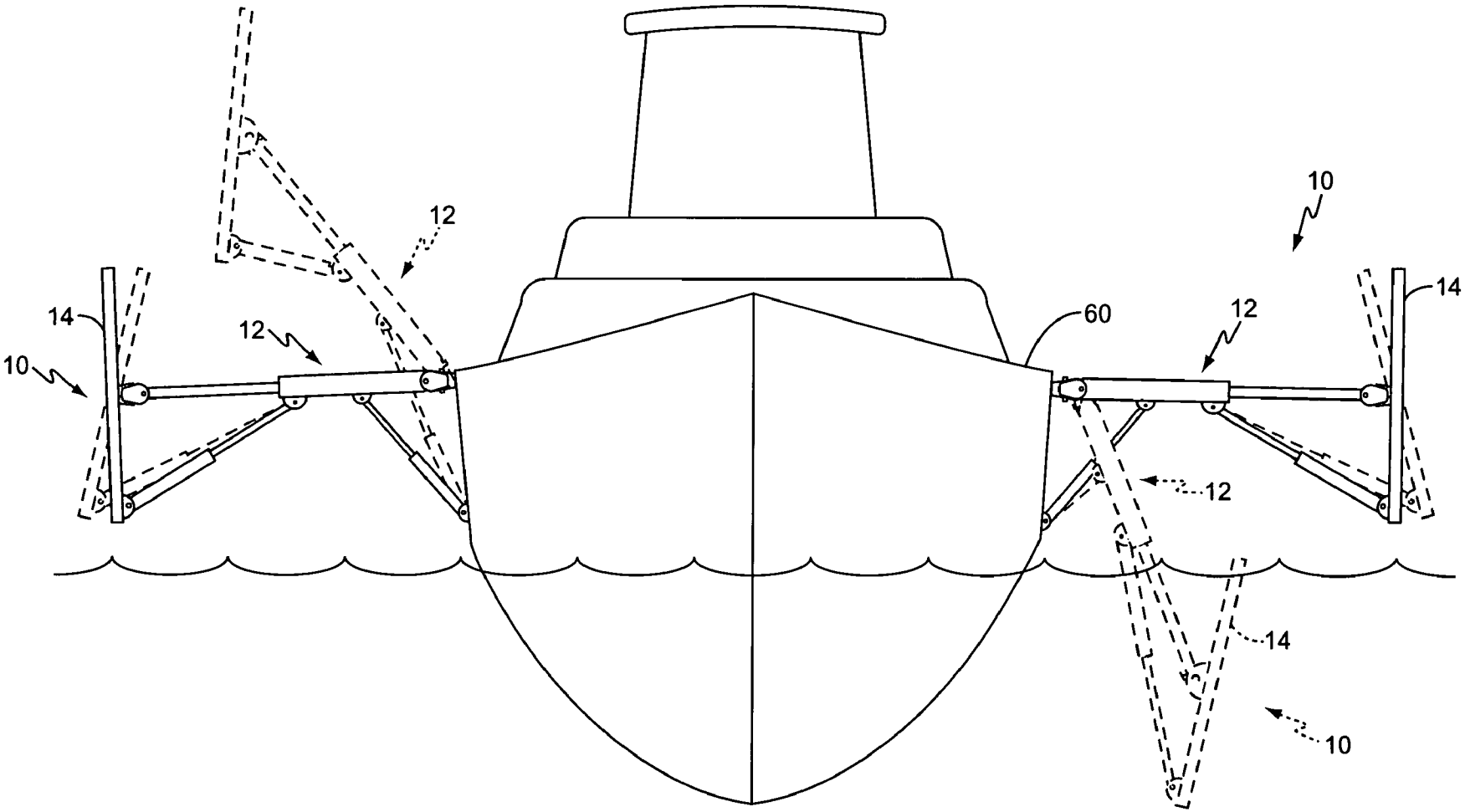
FIG. 6 illustrates possible exemplary deployment positions for one embodiment of the present invention.

FIG. 6 illustrates examples of possible positions in which the defensive shield 10 may be deployed to defend against an attack. In one position, the defensive shield 10 is raised above the deck of the ship 60 to defend against an aerial attack, such as those attacks originating from an attack fighter. In another position, the defensive shield 10 is raised such that the support arm 12 is substantially horizontal with respect to the waterline to protect against rocket attack. A third example illustrates the shield 14 of defensive shield 10 at least partially submerged under the waterline to protect the ship 60 against underwater attacks, such as a torpedo launched from a submarine or a mine field.

Thus, those skilled in the art will appreciate that the defensive shield 10 of the present invention may be deployed in any number of positions to defend against attacks from a plurality of angles. In fact, support arm 12 need not be a hydraulically operated telescoping arm as indicated in the illustrations. Support arm 12 may also be a plurality of connected links or segments hingedly attached to one another that fold or bend between retracted and deployed positions. Further, support arm 12 may be simply a single, solid arm that folds against the side of the ship, or alternatively, retracts substantially into the hull of the ship.

Figure 7:
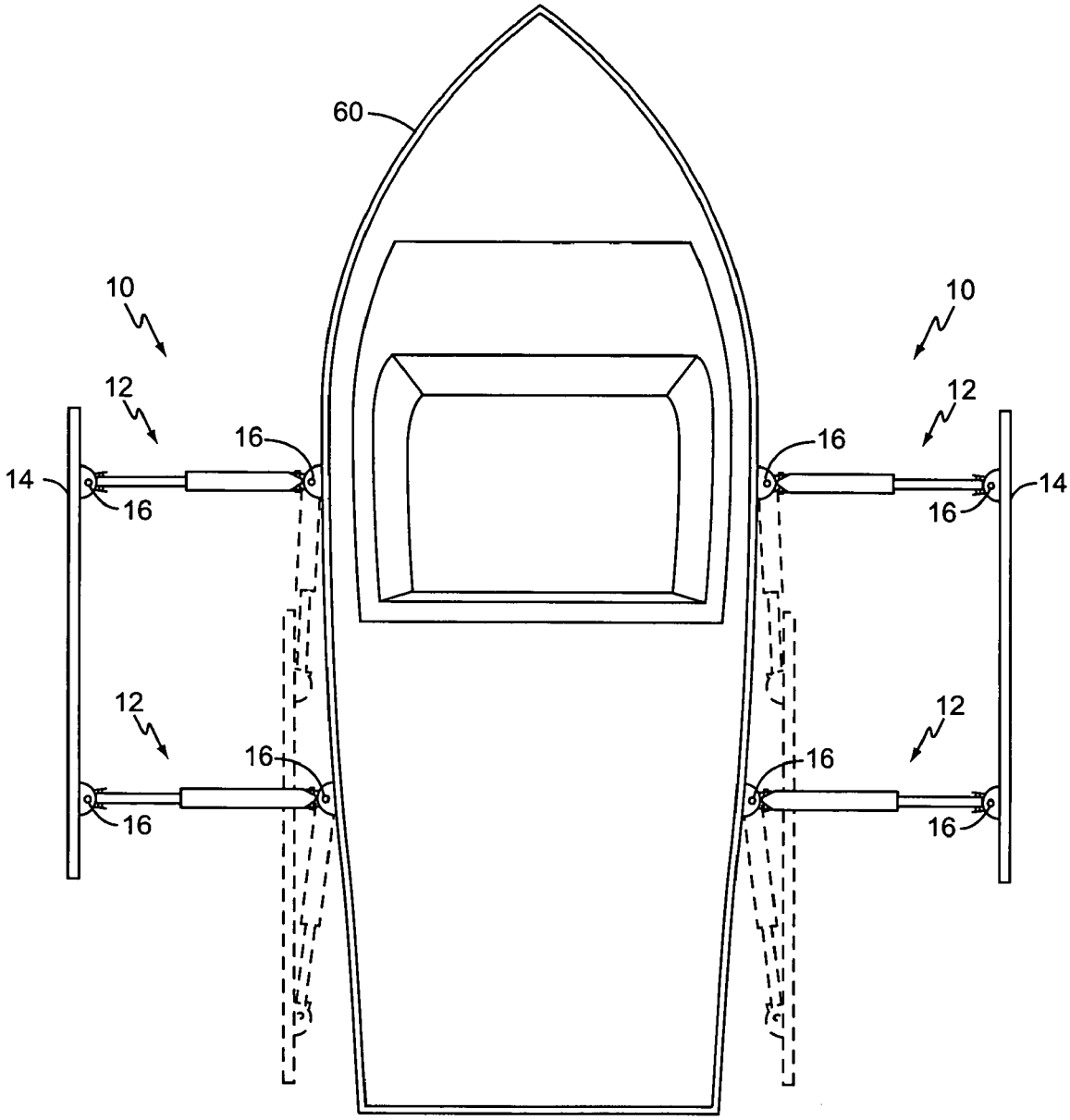
FIG. 7 illustrates an alternate embodiment of the present invention.

Defensive shield 10 may also comprise any number of support arms 12. In an alternate embodiment, shown in FIG. 7, defensive shield 10 comprises two support arms 12 pivotally mounted to ship 60 by hinges 16, and shield 14 pivotally mounted to the end of each support arm 12. As in the earlier embodiments, both the support arms 12 and the shield 14 are both vertically and horizontally positionable, and provide a spatial buffer 54 when deployed in a defensive posture to protect ship 60. Thus, the embodiment illustrated in FIG. 7 may also be used to defend the ship 60 against attacks originating from a plurality of angles, for example, air and underwater attacks. When not in use, the support arms 12 may be positioned such that the defensive shield 10 assumes the retracted position.

The present invention may of course, be carried out in other specific ways than those herein set forth without departing from the essential characteristics of the invention. The present embodiments are, therefore, to be considered in all respects as illustrative and not restrictive and all changes coming within the meaning and equivalency range of the appended claims are intended to be embraced therein.

What is claimed is:

1. A defensive shield for a ship comprising:

a telescoping support arm pivotally mounted to said ship;

a shield pivotally mounted to an end of said telescoping support arm;

said shield being movable between a first deployed position, in which said shield is raised above a waterline and angled upward to defend against aerial attacks, and a second deployed position in which said shield is at least partially submerged below the waterline to defend against underwater attacks; and said shield being outwardly spaced from said ship in said first and second deployed positions.

2. The defensive shield of claim 1 wherein said telescoping support arm is movable to a retracted position against the side of said ship.

3. The defensive shield of claim 1 wherein said telescoping support arm is movable horizontally and vertically with respect to the side of said ship.

4. The defensive shield of claim 3 further comprising an elevation controller coupled to said support arm that moves said telescoping support arm vertically with respect to the side of the ship.

5. The defensive shield of claim 3 further comprising a lateral controller coupled to said telescoping support arm that moves said telescoping support arm horizontally with respect to the side of the ship.

6. The defensive shield of claim 1 wherein said shield is pivotable horizontally and vertically with respect to said telescoping support arm.

7. The defensive shield of claim 6 further comprising a vertical tilt controller coupled to said shield that tilts said shield vertically with respect to said telescoping support arm.

8. The defensive shield of claim 6 further comprising a horizontal tilt controller coupled to said shield that tilts said shield horizontally with respect to said telescoping support arm.

9. The defensive shield of claim 1 wherein said shield is further movable to a third deployed position between said first and second deployed positions.

10. The defensive shield of claim 9 wherein said shield is outwardly spaced from said ship in said third deployed position.

11. The defensive shield of claim 1 further comprising a primary controller to control the movements of said telescoping support arm and said shield.

12. The defensive shield of claim 11 further comprising a first plurality of fluid cylinders coupled to said primary controller that move said telescoping support arm vertically and horizontally with respect to the side of said ship.

13. The defensive shield of claim 12 further comprising a second plurality of fluid cylinders coupled to said primary controller that move said shield vertically and horizontally with respect to said telescoping support arm.

14. The defensive shield of claim 13 wherein said first plurality of fluid cylinders and said second plurality of fluid cylinders comprise hydraulic cylinders.

15. The defensive shield of claim 1 wherein said telescoping support arm further comprises an articulating arm.

16. The defensive shield of claim 1 wherein said telescoping support arm is a hydraulic telescoping arm.

17. The defensive shield of claim 1 wherein said telescoping support arm comprises a first telescoping support arm.

18. The defensive shield of claim 17 further comprising a second support arm pivotally mounted to the ship, and wherein said shield is pivotally mounted to each of said first and second support arms.

* * * * *